US009167650B2

(12) United States Patent
Park et al.

(10) Patent No.: US 9,167,650 B2
(45) Date of Patent: Oct. 20, 2015

(54) LIGHT SOURCE DRIVE CIRCUIT

(71) Applicant: LG DISPLAY CO., LTD., Seoul (KR)

(72) Inventors: Hyo Joon Park, Paju-si (KR); Sang Yong Kim, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 37 days.

(21) Appl. No.: 14/091,059

(22) Filed: Nov. 26, 2013

(65) Prior Publication Data

US 2014/0145640 A1 May 29, 2014

(30) Foreign Application Priority Data

Nov. 29, 2012 (KR) ..... 10-2012-0136751

(51) Int. Cl.
*H05B 41/16* (2006.01)
*H05B 41/24* (2006.01)
*H05B 33/08* (2006.01)

(52) U.S. Cl.
CPC ..... *H05B 33/0824* (2013.01); *H05B 33/0815* (2013.01)

(58) Field of Classification Search
None
See application file for complete search history.

(56) References Cited

U.S. PATENT DOCUMENTS

| | | | | |
|---|---|---|---|---|
| 7,710,049 | B2 | 5/2010 | Wang et al. | |
| 8,324,816 | B2 * | 12/2012 | Ohashi et al. | 315/127 |
| 2011/0156603 | A1 * | 6/2011 | Ko et al. | 315/185 R |
| 2012/0098462 | A1 * | 4/2012 | Inoue et al. | 315/297 |
| 2013/0088158 | A1 * | 4/2013 | Lin | 315/186 |

FOREIGN PATENT DOCUMENTS

| | | | |
|---|---|---|---|
| CN | 101222805 | A | 7/2008 |
| TW | 201123986 | A | 7/2011 |

* cited by examiner

*Primary Examiner* — Anh Tran
(74) *Attorney, Agent, or Firm* — Birch, Stewart, Kolasch & Birch, LLP

(57) ABSTRACT

A light source drive circuit is disclosed which uses a low withstanding voltage transistor is discussed. The light source drive circuit can enhance price competitiveness. Also, the light source drive circuit can allow a current flowing through an LED portion to be eliminated when a PWM signal is not applied. Therefore, the light source drive circuit can enhance a contrast ratio.

18 Claims, 8 Drawing Sheets

LIGHT SOURCE DRIVE CIRCUIT

The present application claims priority under 35 U.S.C. §119(a) of Korean Patent Application No. 10-2012-0136751 filed on Nov. 29, 2012, which is hereby incorporated by reference in its entirety.

BACKGROUND

1. Field of the Disclosure

The present application relates to a light source drive circuit.

2. Description of the Related Art

Nowadays, a variety of display devices for displaying information are being developed. The display devices include cathode ray tubes, liquid crystal display (LCD) devices, plasma display panel devices, organic light emitting display (OLED) device, electroluminescent display devices and so on.

Among these display devices, the liquid crystal display devices can be made lighter and thinner than the cathode ray tubes. Also, the LCD devices have a feature of lower power consumption than the CRTs. Such LCD devices are not self-illuminating display devices, unlike the OLED devices and so on. As such, the LCD devices need a backlight unit used as a rear light source.

Actually, LEDs (Light Emission Diodes), at least one CCFL (Cold Cathode Fluorescence Lamp) or others are being used as the light source. The LEDs have superior response properties. Also, the LEDs can be manufactured in a variety of shape. As such, the LEDs are mainly being used as the light source of the back light unit.

A light source drive circuit for driving the LEDs is configured with several components including a transistor. Also, a high voltage can be applied to the transistor of the light source drive circuit. As such, a high voltage as high withstanding voltage transistor can be used as the transistor of the light source drive circuit. Due to this, price competitiveness of the light source drive circuit can deteriorate.

BRIEF SUMMARY

Accordingly, embodiments of the present invention are directed to a light source drive circuit that substantially obviates one or more of problems due to the limitations and disadvantages of the related art.

The embodiments are to provide a light source drive circuit with a low withstanding voltage transistor.

Also, the embodiments are to provide a light source drive circuit which is adapted to enhance contrast ratio.

Additional features and advantages of the embodiments will be set forth in the description which follows, and in part will be apparent from the description, or may be learned by practice of the embodiments. The advantages of the embodiments will be realized and attained by the structure particularly pointed out in the written description and claims hereof as well as the appended drawings.

According to a general aspect of the present embodiment, a light source drive circuit can include: an LED (Light Emission Diode) portion connected to a first node; a voltage controller connected to the first node and configured to control a voltage of the LED portion; and a current controller connected a second node and configured to control a current of the LED portion. The current controller can include: a first transistor connected to the second node and switched according to a PWM (Pulse Width Modulation) signal; a first resistor connected to the second node; and a second resistor connected to the first transistor. If the first transistor is turned-on, a first current passing through the LED portion can be applied to the second resistor. When the first transistor is turned-off, a second current passing through the LED portion is applied to the first resistor.

A light source drive circuit according to another general aspect of the present embodiment can include: an LED (Light Emission Diode) portion connected to a first node; a voltage controller connected to the first node and configured to control a voltage of the LED portion; and a current controller connected a second node and configured to control a current of the LED portion. The current controller can include: a first transistor switched by a PWM signal and configured to include a drain electrode, which is connected to a third node, and a source electrode which is connected to a ground line; a first resistor connected between the third node and a supply voltage line; a second transistor switched by a voltage at the third node and configured to include a drain electrode, which is connected to a fourth node, and a source electrode which is connected to the ground line; a second resistor connected to the fourth node and a fifth node; a third resistor connected to the fifth node and the ground line; a constant current source connected to the fifth node and the ground line; a first operational amplifier configured to include an inversion terminal, which is connected to the fifth node, and a non-inversion terminal and an output terminal which are connected to each other; a second operational amplifier configured to include a non-inversion terminal which is connected to the output terminal of the first operational amplifier, an output terminal which is connected to a sixth node, and an inversion terminal which is connected to a seventh node; a fourth resistor connected between the seventh node and the ground line; and a third transistor switched by a voltage at the sixth node and configured to include an emitter electrode, which is connected to the seventh node, and a collector electrode which is connected to the second node. As such, a current flowing through the LED portion depends on the PWM signal.

A light source drive circuit according to still another general aspect of the present embodiment can include: an LED (Light Emission Diode) portion connected to a first node; a first resistor connected between the first node and a ground line; a second resistor connected between a second node and the ground line; and a transistor connected between the first and second nodes and switched by a PWM signal.

Other systems, methods, features and advantages will be, or will become, apparent to one with skill in the art upon examination of the following figures and detailed description. It is intended that all such additional systems, methods, features and advantages be included within this description, be within the scope of the present disclosure, and be protected by the following claims. Nothing in this section should be taken as a limitation on those claims. Further aspects and advantages are discussed below in conjunction with the embodiments. It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the embodiments and are incorporated herein and constitute a part of this application, illustrate embodiment(s) of the present disclosure and together with the description serve to explain the disclosure. In the drawings.

DETAILED DESCRIPTION OF THE EMBODIMENTS

Figure 1:
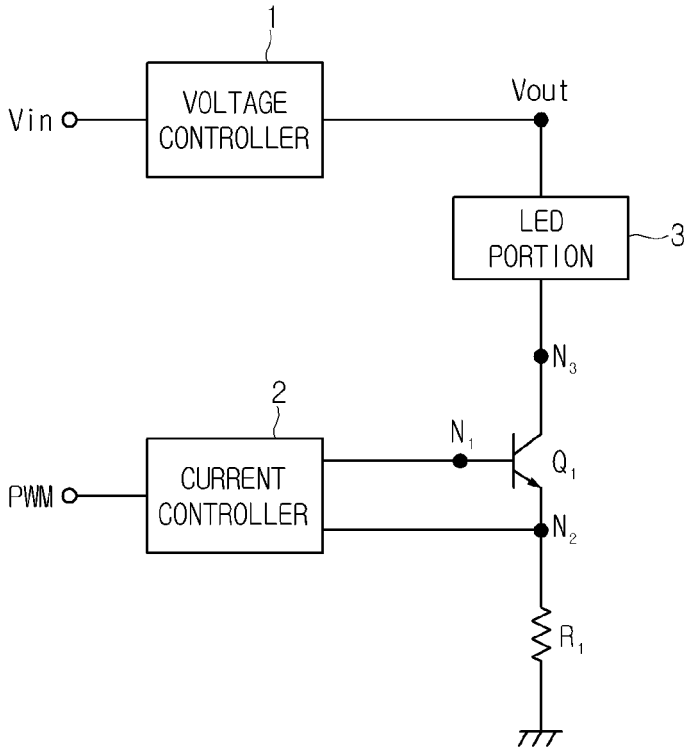
FIG. 1 is a circuit diagram showing a light source drive circuit according to a first embodiment of the present disclosure.

Reference will now be made in detail to the embodiments of the present disclosure, examples of which are illustrated in the accompanying drawings. These embodiments introduced hereinafter are provided as examples in order to convey their spirits to the ordinary skilled person in the art. Therefore, these embodiments might be embodied in a different shape, so are not limited to these embodiments described here. In the drawings, the size, thickness and so on of a device can be exaggerated for convenience of explanation. Wherever possible, the same reference numbers will be used throughout this disclosure including the drawings to refer to the same or like parts.

FIG. 1 is a circuit diagram showing a light source drive circuit according to a first embodiment of the present disclosure.

Referring to FIG. 1, the light source drive circuit according to a first embodiment of the present disclosure includes a voltage controller 1, a current controller 2 and an LED portion 3. Also, the light source drive circuit can include a transistor Q1.

The voltage controller 1 can be connected to an input voltage terminal Vin and an output voltage node Vout. The current controller 2 can be connected between a PWM (Pulse width modulation) signal terminal PWM and first and second nodes N1 and N2. The PWM signal terminal PWM can be used to receive a PWM signal. The LED portion 3 can be connected to the output voltage node Vout and a third node N3. A base electrode of the transistor Q1 can be connected to the first node N1, an emitter electrode of the transistor Q1 can be connected to the second node N2, and a collector electrode of the transistor Q1 can be connected to the third node N3.

The PWM signal can be a periodic signal. As such, the PWM signal can include pulses being enabled in a fixed interval. The width of the PWM pulse (i.e., a duty cycle ratio of the PWM signal) can be adjusted in order to control light quantity of the LED portion 3.

The voltage controller 1 can amplify an input voltage. Also, the voltage controller 1 can apply the amplified voltage to the output voltage node Vout as a fixed output voltage Vout.

The current controller 2 can control a voltage between the first and second nodes N1 and N2 in response to the PWM signal on the PWM signal terminal PWM. As such, current quantity flowing from the collector electrode of the transistor Q1 to the emitter electrode of the transistor Q1 can be controlled. Therefore, current quantity flowing through the LED portion 3 can be adjusted.

When the transistor T1 is activated (i.e., turned-on), the current can flow through the LED portion 3. As such, the LED portion 3 can be driven. Such LED portion 3 can include at least one LED, but it is not limited to this.

Figure 2:
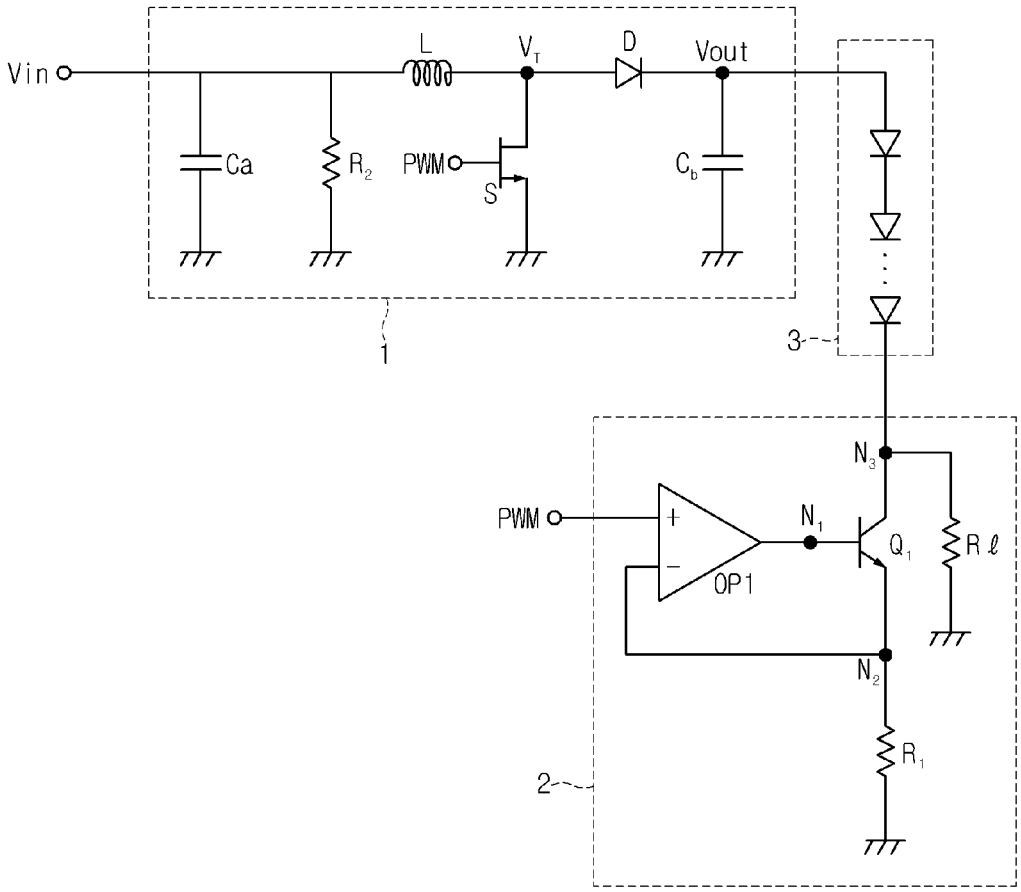
FIG. 2 is a detailed circuit diagram showing a light source drive circuit of FIG. 1.

FIG. 2 is a circuit diagram showing a light source drive circuit of FIG. 1.

As shown in FIG. 2, the light source drive circuit according to a first embodiment of the present disclosure can include a voltage controller 1, a current controller 2, an LED portion 3 and a load resistor Rl.

The voltage controller 1 can include a first capacitor Ca connected between an input voltage terminal Vin and a ground line GND, a second resistor R2 between the input voltage terminal and the ground line GND, and an inductor L connected between the input voltage terminal Vin and a Vt node Vt. Also, the voltage controller 1 can include a switch element S connected between the Vt node Vt and the ground line GND, a diode D connected between the Vt node Vt and an output voltage node Vout, and a second capacitor Cb connected between the output voltage node Vout and the ground line GND.

The LED portion 3 can include at least one LED. An anode electrode of the LED can be connected to the output voltage node Vout. A cathode electrode of the LED can be connected to a third node N3.

In operation of the voltage controller 1, a fixed input voltage Vin can be applied to the voltage controller 1, and the switch element S can be turned-on. As such, a current can flows through the inductor L and energy can be stored in the inductor L. At the same time, the current flowing through the inductor L can also flow through the switch element S.

If the switch element S is turned-off, the sum voltage of the input voltage Vin and the energy voltage stored into the inductor L can be applied to the output voltage node Vout. As such, the second capacitor Cb can be charged with the sum voltage on the output voltage node Vout.

When the switch element S is again turned-on, the current can flow through the inductor L and the switch element S. At the same time, the diode D can prevent the feedback of the charged voltage of the second capacitor Cb toward the left hand of the voltage controller 1. As such, the charged voltage of the second capacitor Cb can be applied to the LED portion 3 which is positioned in the right side of the voltage controller 1.

As the above-mentioned operation is repeatedly performed, the input voltage Vin can be amplified and the amplified voltage can be applied to the output voltage node Vout as an output voltage Vout. Also, the second capacitor Cb is repeatedly performed charging and discharging operations. Due to this, ripples must be generated in the output voltage Vout. However, the ripples can be largely reduced by increasing the capacitance value of the second capacitor Cb. In this case, the voltage at the output voltage node Vout can be approximated a fixed voltage.

The current controller 2 can include an operational amplifier OP1, a transistor Q1 and first resistor R1. A non-inversion terminal of the operational amplifier OP1 can be connected to a PWM signal terminal PWM, an inversion terminal of the operational amplifier OP1 can be connected to a second node N2, and an output terminal of the operational amplifier OP1. A base electrode of the transistor Q1 can be connected to the first node N1, an emitter electrode of the transistor Q1 can be connected to the second node N2, and a collector electrode of the transistor Q1 can be connected to a third node N3. The load resistor Rl is connected between the third node N3 and the ground line GND.

The operational amplifier OP1 can control a current flowing through the transistor Q1 by comparing a PWM signal voltage applied from the PWM signal terminal PWM with a voltage applied to the first resistor R1 and supplying the base electrode of the transistor Q1 with a different voltage of the compared voltages. For example, the PWM signal with a high logic voltage is applied to the non-inversion terminal of the operational amplifier OP1, the output voltage of the operational amplifier OP1 can be larger than the voltage at the second node N2. As such, the transistor Q1 can be turned-on and the current can flow through the transistor Q1. On the contrary, when the PWM signal with a low logic voltage is applied to the non-inversion terminal of the operational amplifier OP1, the output voltage of the operational amplifier OP1 can be smaller than the voltage at the second node N2. Therefore, the transistor Q1 can be turned-off, and the current flowing through the transistor Q1 can be shielded.

The transistor Q1 is turned-off when the PWM signal with the low logic voltage is applied to the non-inversion terminal of the operational amplifier OP1. At the same time, the current flowing through the LED portion 3 can be applied to only the load resistor Rl.

Figure 3:
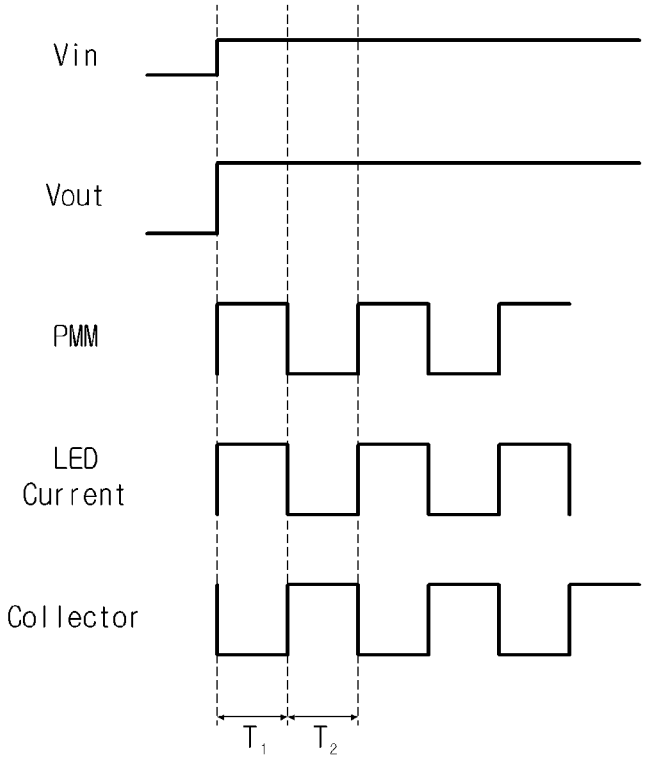
FIG. 3 is a waveform diagram illustrating the operation of the light source drive circuit according to a first embodiment of the present disclosure.

FIG. 3 is a waveform diagram illustrating the operation of the light source drive circuit according to a first embodiment of the present disclosure.

Referring to FIG. 3, the voltage controller 1 amplifies the input voltage Vin and applies the amplified voltage to the output voltage node Vout as a fixed output voltage Vout, during a first time interval T1. At the same time, the current controller 2 replies the PWM signal with the high logic voltage and turns-on the transistor Q1. As such, the current can flow through the LED portion 3. At this time, a low voltage of 0V can be developed at the collector electrode of the transistor Q1.

In a second time interval T2, the PWM signal with the low logic voltage can be applied to the current controller 2. As such, the transistor Q1 can be turned-off and the current flowing through the transistor Q1 can be shielded. Also, the current passing through the LED portion 3 can flow through only the load resistor Rl. Therefore, a relative high voltage not being '0V' can be developed at the collector electrode of the transistor Q1.

The voltage developed at the third node N3 can be controlled by adjusting the resistance value of the load resistor Rl. As such, the voltage applied to the collector electrode of the transistor Q1 can be controlled. Therefore, a low withstanding voltage transistor can be used as the transistor Q1.

In this manner, the voltage applied to the collector electrode of the transistor Q1 can be lowered. As such, a low withstanding voltage transistor can be used in the light source drive circuit. Therefore, manufacture costs of the light source drive circuit can be reduced.

Figure 4:
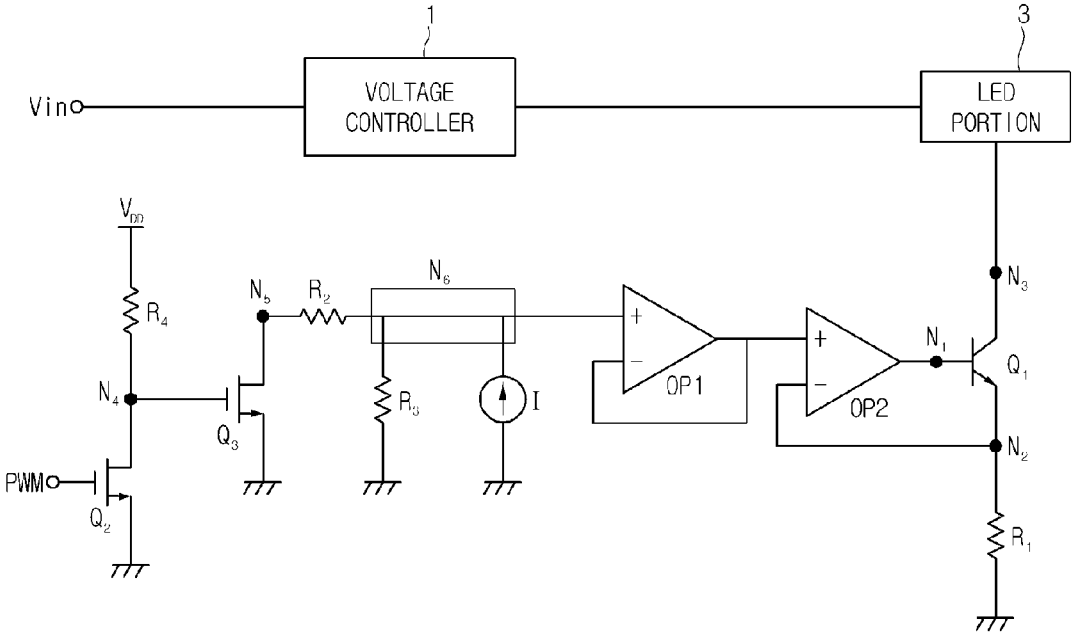
FIG. 4 is a circuit diagram showing a light source drive circuit according to a second embodiment of the present disclosure.

FIG. 4 is a circuit diagram showing a light source drive circuit according to a second embodiment of the present disclosure.

Referring to FIG. 4, the light source drive circuit according to a second embodiment of the present disclosure can include a voltage controller 1, a current controller 2 and an LED portion 3.

The current controller 2 can include first through third transistors Q1~Q3, a constant current source I, first and second operational amplifiers OP1 and OP2 and first through fourth resistors R1~R4. A gate electrode of the second transistor Q2 can be connected to a PWM signal terminal PWM, a source electrode of the second transistor Q2 can be connected to a ground line GND, and a drain electrode of the second transistor Q2 can be connected to a fourth node N4. The fourth resistor R4 can be connected between an external voltage line VDD and the fourth node N4. A gate electrode of the third transistor Q3 can be connected to the fourth node N4, a source electrode of the third transistor Q3 can be connected to the ground line GND, and a drain electrode of the third transistor Q3 can be connected to a fifth node N5. The second resistor R2 can be connected between the fifth node N5 and a sixth node N6. The third resistor R3 can be connected between the ground line GND and the sixth node N6. The constant current source I can be connected between the sixth node N6 and the ground line GND. The first and second operational amplifiers OP1 and OP2 can be connected between the sixth node N6 and first and second nodes N1 and N2.

In the operation of the light source drive circuit, when a PWM signal with a high logic voltage is applied to the PWM signal terminal PWM, the second transistor Q2 is turned-off and allows the gate electrode of the third transistor Q3 to be connected to the ground line GND. As such, the third transistor Q3 can be turned-off. In this case, a fixed current output from the constant current source I can flow through the third resistor R3. Therefore, a fixed voltage can be developed at the sixth node N6.

If the PWM signal with a low logic voltage is applied to the PWM signal terminal PWM, the second transistor Q2 is turned-off but the third transistor Q3 is turned-on by an external voltage VDD which is applied to its gate electrode via the fourth resistor R4. In this case, the fixed current output from the constant current source I can flow through both the second and third resistors R2 and R3. As such, a relative low voltage of '$\{R2 \cdot R3/(R2+R3)\} \cdot I$' can be developed at the sixth node N6. In other words, the voltage developed at the sixth node N6 can be lowered when the PWM signal with the low logic voltage is applied, compared to when the PWM signal with the high logic voltage is applied. In accordance therewith, a voltage applied from the second operational amplifier OP2 to the first node N1 can become lower, and furthermore a current flowing from the LED portion 3 through the first transistor Q1. Consequently, the current flowing through the first transistor Q1 can be adjusted because a voltage between the base and emitter electrodes of the first transistor Q1 (i.e., a voltage between the first and second nodes N1 and N2) can be adjusted.

Figure 5:
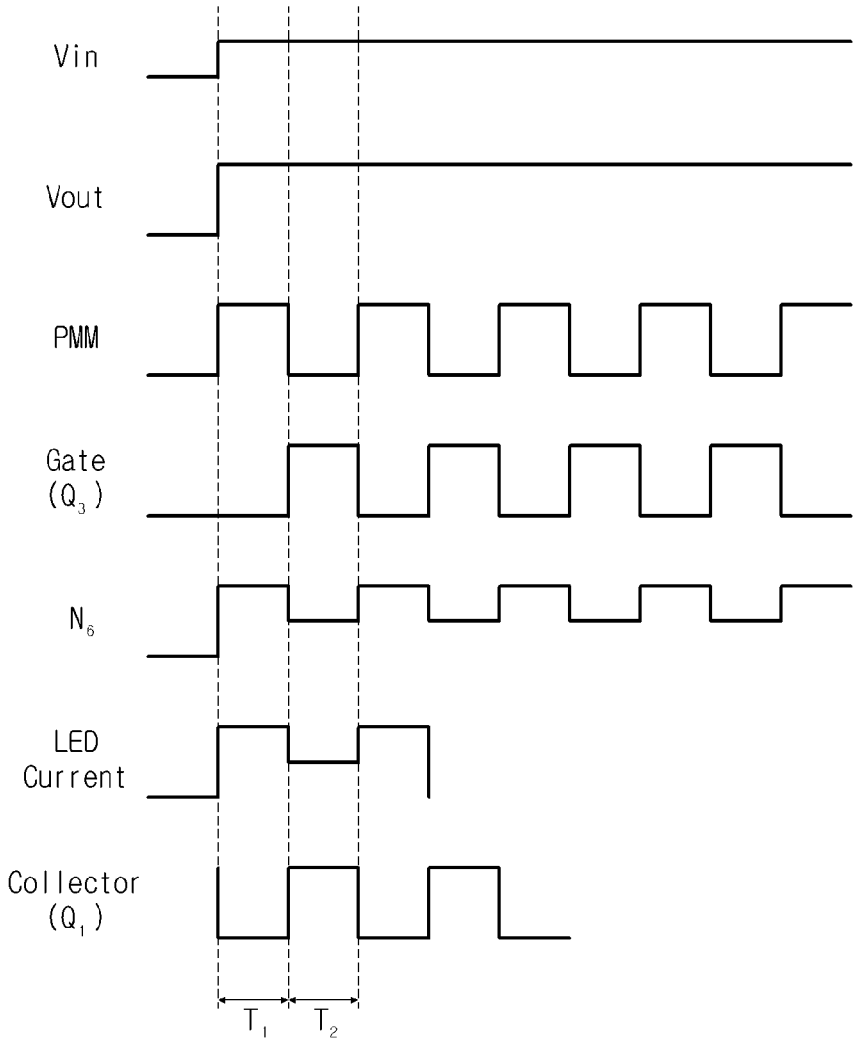
FIG. 5 is a waveform diagram illustrating the operation of the light source drive circuit according to a second embodiment of the present disclosure.

FIG. 5 is a waveform diagram illustrating the operation of the light source drive circuit according to a second embodiment of the present disclosure.

The operation of the light source drive circuit according to a second embodiment of the present disclosure will now be explained in detail referring to FIG. 5. In a first time interval T1, a fixed input voltage Vin can be amplified by the voltage controller 1 and an amplified voltage can be applied from the voltage controller 1 to the output voltage node Vout. Also, the PWM signal with the high logic voltage can be applied to the second transistor Q2. As such, the second transistor Q2 can be turned-on and enable a current to flow from the external voltage line VDD to the ground line GND. Meanwhile, the third transistor Q3 can be turned-off, and the fixed current output from the constant current source I can flow through only the third resistor R3. In accordance therewith, a relative high voltage can be developed at the sixth node N6. The relative high voltage at the sixth node N6 can enable the first and second operational amplifiers OP1 and OP2 to apply a relative high forward-base-voltage to be applied between the base and emitter electrodes of the first transistor Q1, i.e., between the first and second nodes N1 and N2. Therefore, a relative large current can flow through the LED portion 3.

During a second time interval T2, the PWM signal with the low logic voltage can be applied to the second transistor Q2. The second transistor Q2 can be turned-off, but the third transistor Q3 can be turned-on by a current applied from the external voltage line VDD to its gate electrode. As such, the fixed current output from the constant current source I can be branched into the second and third resistors R2 and R3, and a relative lower voltage than that of the first time interval T1 can be developed at the sixth node N6. The relative lower voltage at the sixth node N6 can enable the first and second operational amplifier OP1 and OP2 to apply a relative low forward-bias-voltage between the base and emitter electrodes of the first transistor Q1, i.e., between the first and second nodes N1 and N2. In accordance therewith, a relative small current can flow through the LED portion 3.

In other words, the voltage of the sixth node N6 can be lower in the second time interval T2, compared to that of the first time interval T1. As such, the forward bias voltage between the base and emitter electrode of the first transistor Q1 in the second time interval T2 can be also lower than that of the first time interval T1. In accordance therewith, the current flowing through the LED portion 3 in the second time interval T2 can become smaller than that of the first time interval T1.

In the first time interval T1 in which the PWM signal with the high logic voltage is applied to the PWM signal terminal, the first transistor Q1 can be turned-on and a voltage of '0V' can be developed at the collector electrode of the first transistor Q1 which is connected to the third node N3. In the second time interval T2 in which the PWM signal with the low logic voltage is applied to the PWM signal terminal, a fixed current can flow through the LED portion 3. As such, the voltage developed at the collector electrode of the first transistor Q1 can become lower than that when any current does not flow through the LED portion 3. Moreover, the voltage developed at the collector electrode of the first transistor Q1 when the PWM signal has the low logic voltage can become lower by adjusting the resistance values of the second and third resistors R2 and R3. In accordance therewith, a low withstanding voltage transistor can be used as the first transistor Q1, and furthermore price competitiveness of the light source drive circuit can become higher.

Figure 6:
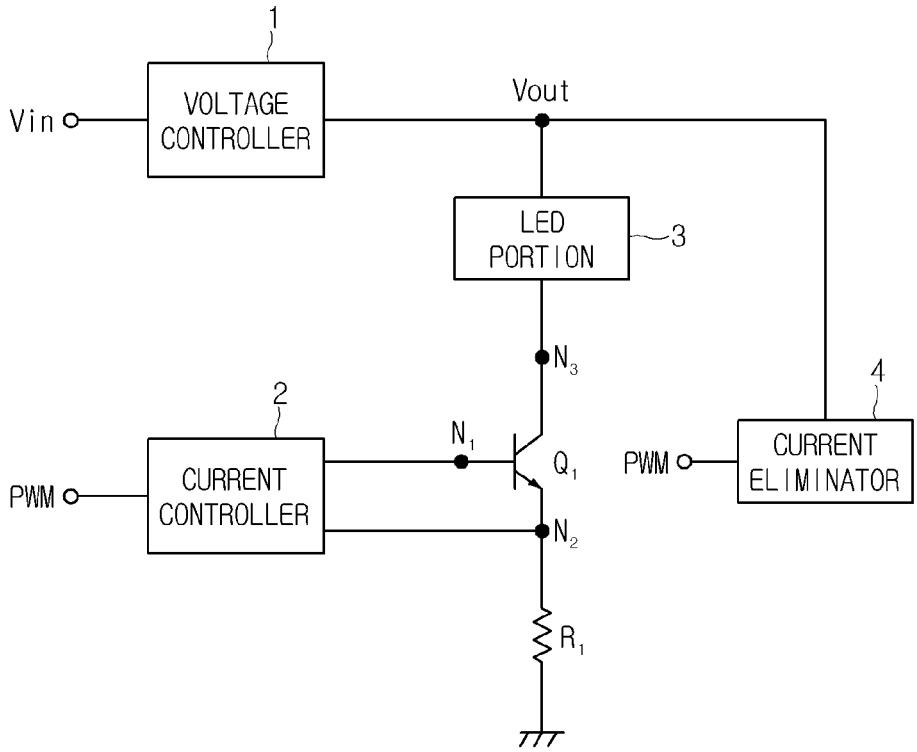
FIG. 6 is circuit diagram showing a light source drive circuit, which has a current eliminator, according to a third embodiment of the present disclosure.

FIG. 6 is circuit diagram showing a light source drive circuit, which has a current eliminator, according to a third embodiment of the present disclosure.

Referring to FIG. 6, the light source drive circuit according to a third embodiment of the present disclosure can include a voltage controller 1, a current controller 2, an LED portion 3 and a current eliminator 4. The current eliminator 4 can be connected to an output voltage node Vout and a PWM signal terminal which receives a PWM signal. Also, the light source drive circuit can include a first transistor Q1 and a first resistor R1.

If the PWM signal is not applied during a fixed time period, the current eliminator 4 can eliminate a current flowing through the LED portion 3.

Figure 7:
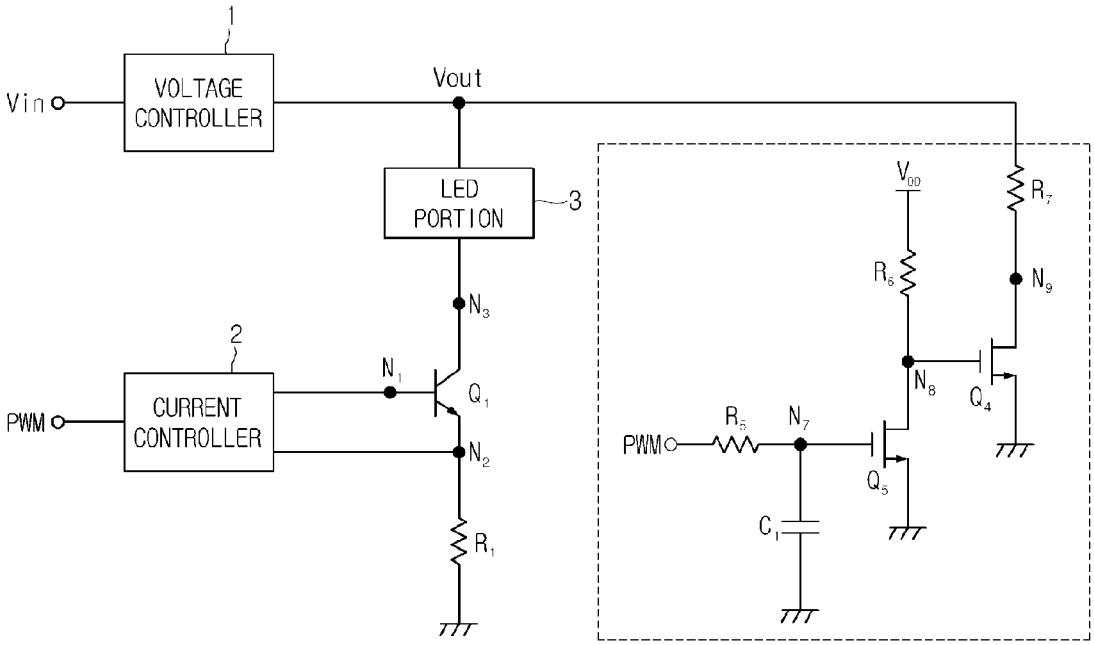
FIG. 7 is a detailed circuit diagram showing a light source drive circuit of FIG. 6.

FIG. 7 is a detailed circuit diagram showing a light source drive circuit of FIG. 6.

As shown in FIG. 7, the light source drive circuit according to a third embodiment of the present disclosure can include a voltage controller 1, a current controller 2, an LED portion 3 and a current eliminator 4. The light source drive circuit can further include a first transistor Q1 and a first resistor R1.

The current eliminator 4 can include fourth and fifth transistor Q4 and Q5, fifth through seventh resistors R5~R7 and a capacitor C1. The fifth resistor R5 can be connected between the PWM signal terminal PWM and a seventh node N7. The capacitor C1 can be connected between the seventh node N7 and a ground line GND. The fourth transistor Q4 can include a gate electrode connected to the seventh node N7, a source electrode connected to the ground line GND, and a drain electrode connected to an eighth node N8. The sixth resistor R6 can be connected an external voltage line VDD and the eighth node N8. The fifth transistor Q5 can include a gate electrode connected to the eight node N8, a source electrode connected to the ground line GND, and a drain electrode connected to a ninth node N9. The seventh resistor R7 can be connected between the output voltage node Vout and the ninth node N9.

Figure 8:
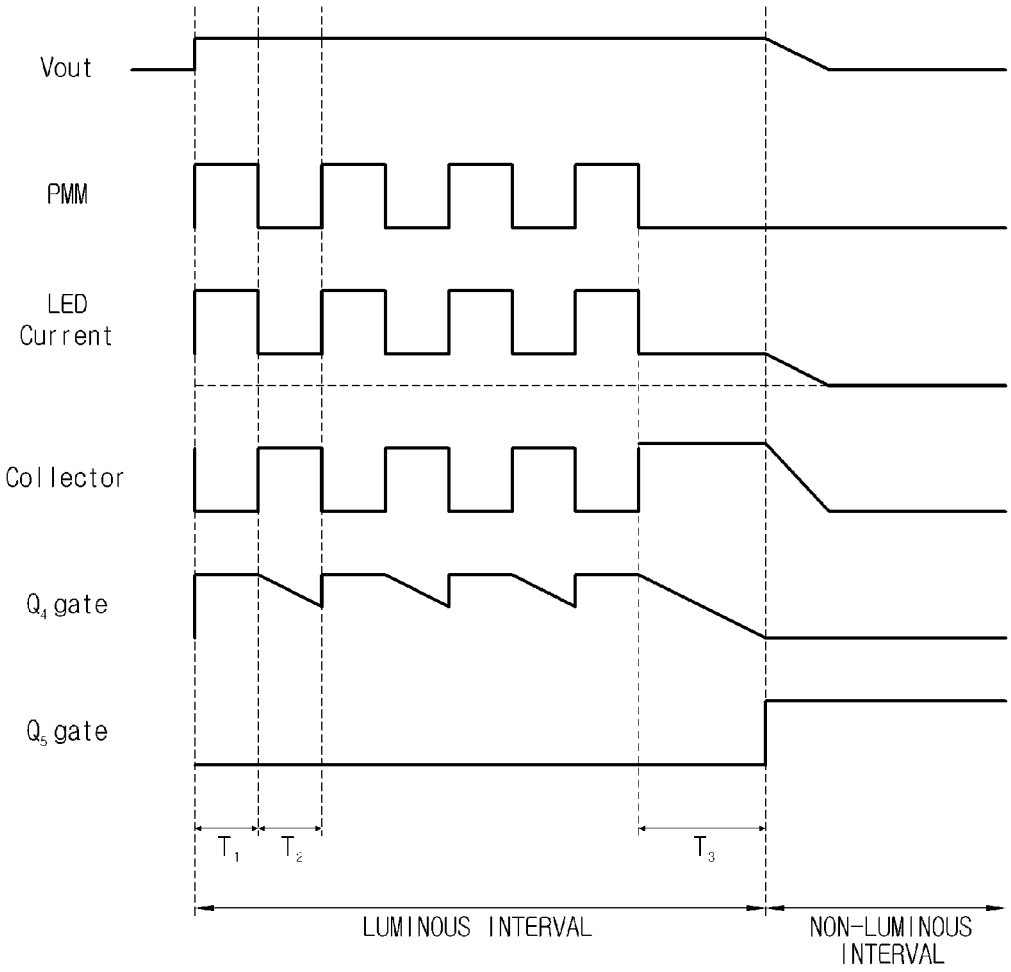
FIG. 8 is a waveform diagram illustrating the operation of the light source drive circuit according to a third embodiment of the present disclosure.

FIG. 8 is a waveform diagram illustrating the operation of the light source drive circuit according to a third embodiment of the present disclosure.

Referring to FIG. 8, in a first time interval T1, a PWM signal with a high logic voltage can be applied to the PWM signal terminal PWM. Then, electric charges can be charged into the capacitor C1 and the fourth transistor Q4 can be turned-on and enable the eighth node N8 to be connected to the ground line GND. As such, the fifth transistor Q5 can be turned-off because a voltage at the gate electrode of the fifth transistor Q5 has a low logic voltage.

Meanwhile, in a second time interval T2, the PWM signal with a low logic voltage can be applied to the PWM signal terminal. As such, energy stored into the capacitor C1 can be discharged, and the voltage applied from the seventh node N7 to the gate electrode of the fourth transistor Q3 can be slowly lowered.

The operations of the first and second time intervals T1 and T2 can be repeatedly performed during a luminous interval. In a third time interval when the PWM signal with the low logic voltage is continuously applied to the PWM signal terminal during at least the fixed time period, the energy stored into the capacitor C1 is sufficiently discharged through the fifth resistor R5. As such, the voltage applied from the seventh node N7 to the gate electrode of the fourth transistor Q4 can be lowered below a threshold voltage of the fourth transistor Q4. When the voltage developed at the seventh node N7 is lower than the threshold voltage, the fourth transistor Q4 can be turned-off.

A non-luminous interval can start from a time point when the fourth transistor Q4 is turned-off. Then, the external voltage VDD is applied to the gate electrode of the fifth transistor Q5. As such, the fifth transistor Q5 can be turned-on and enable the output voltage Vout at the output voltage node Vout to be lowered. In accordance therewith, the current flowing through the LED portion 3 can decrease.

The discharging time of the electric charges stored into the capacitor C1 can depend on the capacitance value of the capacitor C1. If the PWM signal with the low logic voltage is applied during the fixed time period which is determined by the capacitance value of the capacitor C1, the current flowing through the LED portion 3 can be eliminated.

In this way, the current flowing through the LED portion 3 can be eliminated in the non-luminous interval. Therefore, the deterioration of the contrast ratio can be prevented.

Although the present disclosure has been limitedly explained regarding only the embodiments described above, it should be understood by the ordinary skilled person in the art that the present disclosure is not limited to these embodiments, but rather that various changes or modifications thereof are possible without departing from the spirit of the present disclosure. Accordingly, the scope of the present disclosure shall be determined only by the appended claims and their equivalents.

What is claimed is:

1. A light source drive circuit comprising:

an LED (Light Emission Diode) portion connected to a first node;

a voltage controller connected to the first node and configured to control a voltage of the LED portion; and a current controller connected a second node and configured to control a current of the LED portion and to include:

a first transistor connected to the second node and switched according to a PWM (Pulse Width Modulation) signal;

a first resistor connected to the second node;

a second resistor connected to the first transistor; and a current eliminator configured to eliminate the current flowing through LED portion by discharging a voltage at the first node when the PWM signal is not applied, wherein a first current passing through the LED portion is applied to the second resistor when the first transistor is turned-on, and a second current passing through the LED portion is applied to the first resistor when the first transistor is turned-off.

2. The light source drive circuit of claim 1, wherein the first current is larger than the second current.

3. The light source drive circuit of claim 1, wherein the voltage controller receives an input voltage, amplifies the input voltage, and applies the amplified voltage to the LED portion as an output voltage.

4. The light source drive circuit of claim 1, wherein the current eliminator includes:

a third resistor connected between a third node and an input terminal for the PWM signal;

a capacitor connected between the third node and a ground line;

a second transistor switched by a voltage at the third node and configured to include a drain electrode, which is connected to a fourth node, and a source electrode which is connected to the ground line; and a third transistor switched by a voltage at the fourth node and configured to include a drain electrode, which is connected to a fifth node, and a source electrode which is connected to the ground line.

5. A light source drive circuit comprising:

an LED (Light Emission Diode) portion connected to a first node;

a voltage controller connected to the first node and configured to control a voltage of the LED portion; and a current controller connected a second node and configured to control a current of the LED portion and to include:

a first transistor switched by a PWM (Pulse Width Modulation) signal and configured to include a drain electrode, which is connected to a third node, and a source electrode which is connected to a ground line;

a second transistor switched by a voltage at the third node and configured to include a drain electrode, which is connected to a fourth node, and a source electrode which is connected to the ground line;

a first resistor connected to the fifth node and the ground line;

a constant current source connected to the fifth node and the ground line;

a first operational amplifier configured to include an inversion terminal, which is connected to the fifth node, and a non-inversion terminal and an output terminal which are connected to each other;

a second operational amplifier configured to include a non-inversion terminal which is connected to the output terminal of the first operational amplifier, an output terminal which is connected to a sixth node, and an inversion terminal which is connected to a seventh node;

a second resistor connected between the seventh node and the ground line; and a third transistor switched by a voltage at the sixth node and configured to include an emitter electrode, which is connected to the seventh node, and a collector electrode which is connected to the second node, wherein a current flowing through the LED portion depends on the PWM signal.

6. The light source drive circuit of claim 5, wherein the current flowing through the LED portion become larger when the PWM signal has a high logic voltage, compared to when the PWM signal has a low logic voltage.

7. The light source drive circuit of claim 5, further comprising a current eliminator configured to eliminate the current flowing through LED portion by discharging a voltage at the first node when the PWM signal is not applied.

8. The light source drive circuit of claim 7, wherein the current eliminator includes:

a third resistor connected between an eighth node and an input terminal for the PWM signal;

a capacitor connected between the eighth node and the ground line;

a fourth transistor switched by a voltage at the eighth node and configured to include a drain electrode, which is connected to a ninth node, and a source electrode which is connected to the ground line; and a fifth transistor switched by a voltage at the ninth node and configured to include a drain electrode, which is connected to a tenth node, and a source electrode which is connected to the ground line.

9. A light source drive circuit comprising:

an LED (Light Emission Diode) portion connected to a first node;

a first resistor connected between the first node and a ground line;

a second resistor connected between a second node and the ground line;

a transistor connected between the first and second nodes and switched by a PWM (Pulse Width Modulation) signal; and a current eliminator configured to eliminate a current flowing through LED portion when the PWM signal is not applied.

10. The light source drive circuit of claim 9, wherein the transistor enables a current flowing through the LED portion to become larger when the PWM signal has a high logic voltage, compared to when the PWM signal has a low logic voltage.

11. A light source drive circuit comprising:

an LED (Light Emission Diode) portion connected to a first node;

a first resistor connected between the first node and a ground line;

a first transistor connected between the first node, a second node and switched by a PWM (Pulse Width Modulation) signal; and a current eliminator configured to eliminate a current flowing through LED portion when the PWM signal is not applied.

12. The light source drive circuit of claim 11 further comprising:

a second resistor connected between the second node and the ground line.

13. The light source drive circuit of claim 11, wherein the current eliminator includes:

a third resistor connected between a third node and an input terminal for the PWM signal;

a capacitor connected between the third node and the ground line;

a second transistor switched by a voltage at the third node and configured to include a drain electrode, which is connected to a fourth node, and a source electrode which is connected to the ground line; and a third transistor switched by a voltage at the fourth node and configured to include a drain electrode, which is connected to a fifth node, and a source electrode which is connected to the ground line.

14. The light source drive circuit of claim 5 further comprising:

a fourth resistor connected between the second node and the ground line.

15. The light source drive circuit of claim 1, wherein the voltage controller includes:

a first capacitor connected between an input voltage terminal and a ground line;

a third resistor between the input voltage terminal and the ground line;

an inductor connected between the input voltage terminal and a third node;

a switch element connected between the third node and the ground line;

a diode connected between the third node and the first node; and a second capacitor connected between the first node and the ground line.

16. A display device comprising:

a light source drive circuit comprising:

an LED (Light Emission Diode) portion connected to a first node;

a first resistor connected between the first node and a ground line;

a first transistor connected between the first node, a second node and switched by a PWM (Pulse Width Modulation) signal; and a current eliminator configured to eliminate a current flowing through LED portion when the PWM signal is not applied.

17. The display device of claim 16, wherein the light source drive circuit further comprising:

a second resistor connected between the second node and the ground line.

18. The display device of claim 16, wherein the current eliminator includes:

a third resistor connected between a third node and an input terminal for the PWM signal;

a capacitor connected between the third node and the ground line;

a second transistor switched by a voltage at the third node and configured to include a drain electrode, which is connected to a fourth node, and a source electrode which is connected to the ground line; and a third transistor switched by a voltage at the fourth node and configured to include a drain electrode, which is connected to a fifth node, and a source electrode which is connected to the ground line.

* * * * *